United States Patent [19]

Saotome

[11] 4,179,982

[45] Dec. 25, 1979

[54] DEVICE FOR DETECTING POSITION OF HYDRAULIC CYLINDER

[75] Inventor: Shigeo Saotome, Yokohama, Japan

[73] Assignee: Ishikawajima-Harima Jukogyo Kabushiki Kaisha, Tokyo, Japan

[21] Appl. No.: 837,436

[22] Filed: Sep. 28, 1977

[30] Foreign Application Priority Data

Oct. 5, 1976 [JP] Japan ..... 51/119583

[51] Int. Cl.[2] ..... F01B 31/12

[52] U.S. Cl. ..... 92/5 R; 91/390; 100/169

[58] Field of Search ..... 92/5 R, 130 R, 130 B, 92/143, 51; 91/390; 100/154, 160, 169; 267/119, 130

[56] References Cited

U.S. PATENT DOCUMENTS

| | | | |
|---|---|---|---|
| 3,395,619 | 8/1968 | Grebe | 92/51 |
| 3,839,944 | 10/1974 | Swift | 92/5 R |

*Primary Examiner*—Edgar W. Geoghegan

*Attorney, Agent, or Firm*—Scrivener, Parker, Scrivener & Clarke

[57] ABSTRACT

Disclosed is a device for detecting the displacement of a hydraulic cylinder barrel and its piston with a higher degree of accuracy even when a hydraulic cylinder is subjected to severe vibrations.

6 Claims, 6 Drawing Figures

DEVICE FOR DETECTING POSITION OF HYDRAULIC CYLINDER

DETAILED DESCRIPTION OF THE INVENTION

Hydraulic mills are of the type wherein the displacement or deflection of a bottom roll due to a rolling load or pressure is corrected by a hydraulic cylinder and comprises, as shown in FIG. 1, work rolls 1, backup rolls 2 and a hydraulic cylinder 4. The top work roll 1 and the top backup roll 2 are adjusted in position depending upon a thickness of materials S to be rolled and their diameters, whereas the bottom work and backup rolls 1 and 2 are adjusted in position depending upon a rolling load or pressure by the hydraulic cylinder 4 supporting a chock 3 of the bottom backup roll 2 so that the materials S may be rolled into a desired thickness.

The positional adjustment of the bottom backup roll 2 is effected by the hydraulic cylinder 4 so that the desired spacing between the top and bottom work rolls 1 may be maintained. More particularly, the position of a cylinder body or barrel 4*a* with respect to the position of piston 5 at a predetermined height is detected, and the detected position is compared with a predetermined reference point so that the hydraulic cylinder 4 may be so actuated as to eliminate the deviation of the detected position from the reference point, thereby adjusting the spacing between the work rolls 1 to a desired value.

Of various detecting or sensing means so far employed for detecting the position of hydraulic cylinder 4; that is, the relative position between the cylinder barrel 4*a* and the piston 5, one typical one is shown in FIG. 3. A core B is mounted on the cylinder barrel A while a detecting coil D, on the piston C so that the relative position or deviation may be detected in terms of the spacing between the opposed faces of the cylinder barrel A and the piston C. However the prior art detecting or sensing means have a common defect that the lateral displacement, tilting and vibration between the cylinder barrel A and the piston C result in an error in detection. Especially with the detecting means of the type shown in FIG. 3 and particularly when incorporated in a hot rolling mill, the detection with a higher degree of accuracy has been difficult because the cylinder barrel A is inevitably subjected to strong impact and vibrations due to the rotation of rolls and to the rolling pressure.

The present invention was made to substantially solve the above and other problems and has for its object to provide a hydraulic cylinder position detecting device capable of detecting with a higher degree of accuracy the relative position between the cylinder barrel and the piston even when the cylinder is subjected to severe vibrations.

The present invention will become more apparent from the following description of preferred embodiments thereof taken in conjunction with the accompanying drawings, in which.

Figure 1:
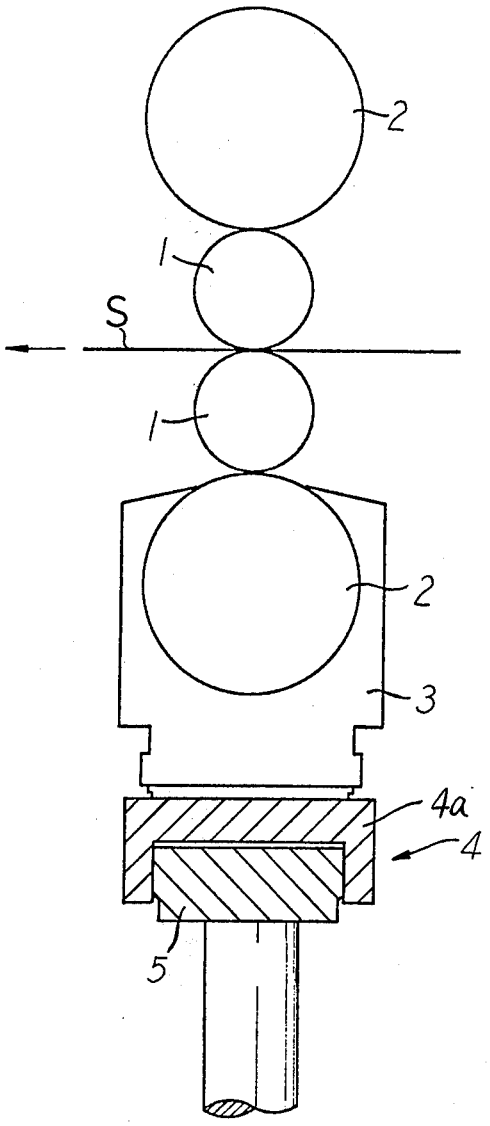
FIG. 1 is a schematic view used for the explanation of the underlying operation principle of hydraulic mills.
Figure 2:
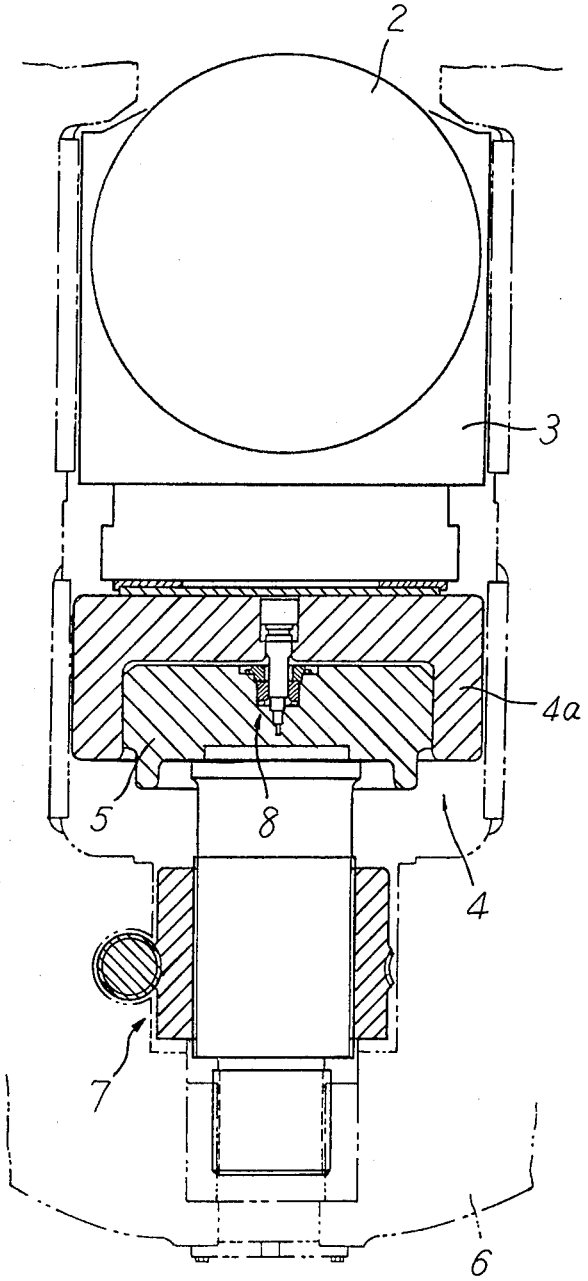
FIG. 2 is a schematic cross sectional view of a hydraulic mill incorporating a hydraulic cylinder position detecting device in accordance with the present invention.
Figure 3:
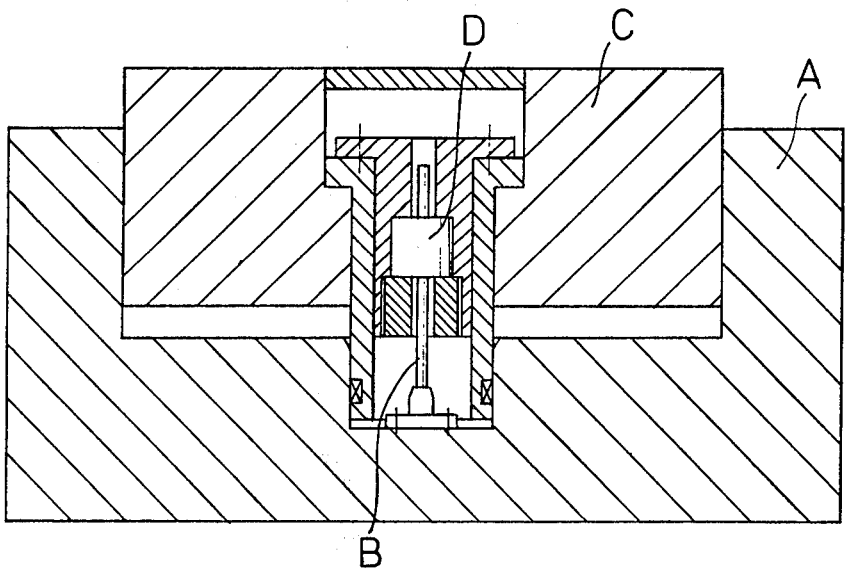
Fig. 3 PRIOR ART
FIG. 3 is a schematic sectional view of a prior art hydraulic cylinder position detecting device.

First referring to FIG. 2, the chock 3 for supporting the bottom backup roll 2 is supported by the hydraulic cylinder 4 having the piston with a piston rod anchored to a stand 6 through a piston position adjusting mechanism 7. A hydraulic cylinder position detecting device 8 in accordance with the present invention is interposed between the cylinder barrel 4*a* and the piston 5 for detecting the relative position between them or the deviation of the position of the cylinder barrel 4*a* from the reference point.

Figure 4:
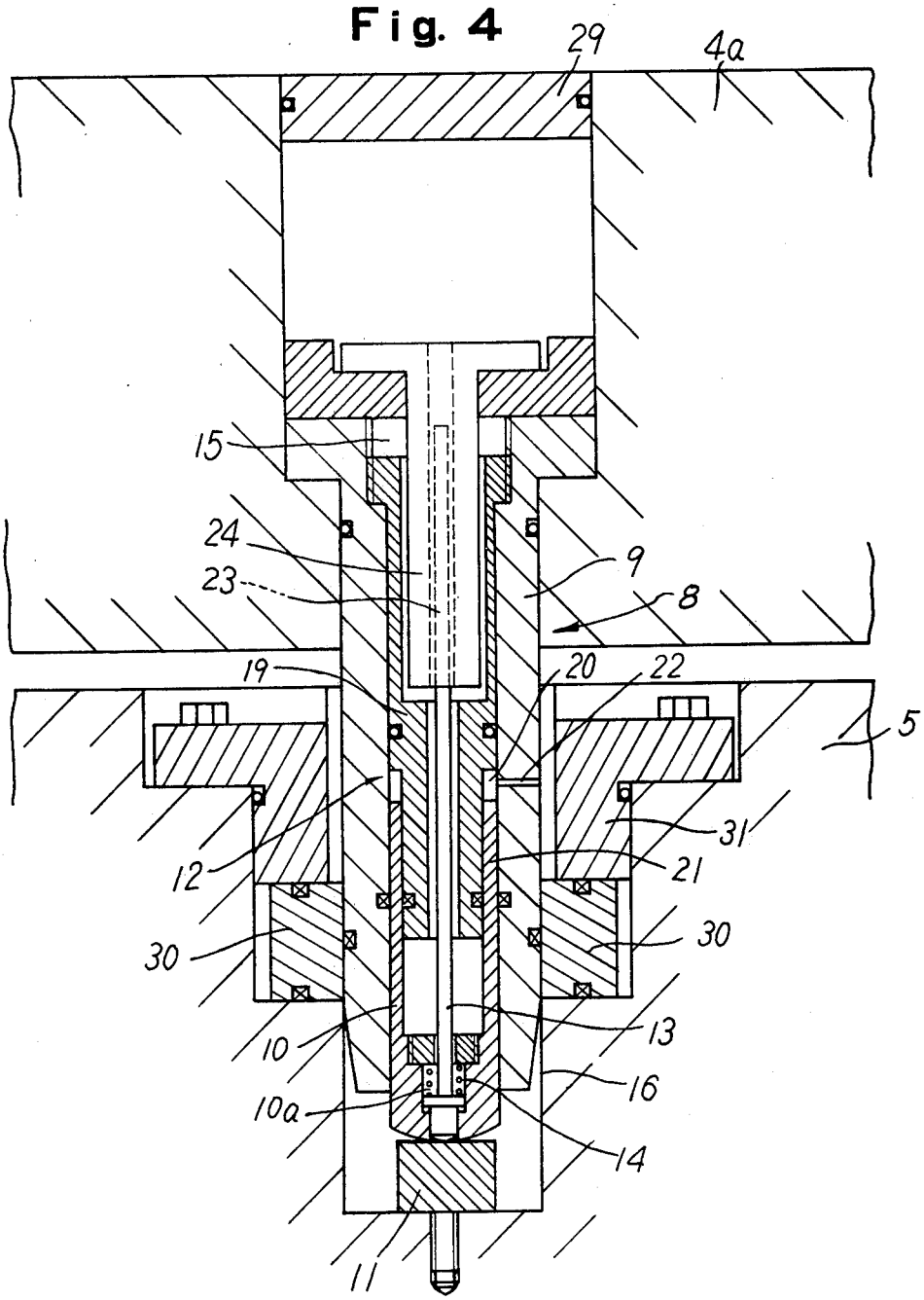
FIG. 4 is a longitudinal sectional view of a first embodiment of a hydraulic cylinder position detecting device in accordance with the present invention.
Figure 5:
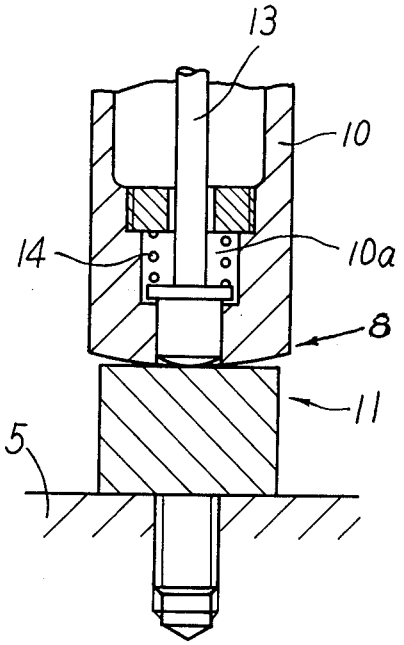
FIG. 5 is a fragmentary sectional view, on enlarged scale, thereof illustrating an inner tube and a rod.

Referring to FIGS. 4 and 5, the cylinder position detecting device 8 comprises in general an outer hollow cylinder 9 securely fitted into a small-diameter hole section of a central or coaxial hole formed through the cylinder barrel 4*a* with its upper flange securely abutted against the annular bottom of the large-diameter section of the coaxial hole and extended downwardly into a coaxial bore or hole 16 formed in the piston 5, an upper or fixed inner cylinder 19 securely fitted into a coaxial through hole of the outer cylinder 9 with the lower end of the upper or fixed inner cylinder spaced apart from the lower end of the outer cylinder by a predetermined distance, a lower or movable inner cylinder 10 slidably fitted into the lower section of the coaxial hole of the outer cylinder with the upper section of the lower cylinder 10 slidably fitted over the lower reduced-diameter section of the upper cylinder 19, the lower end portion of the lower or slidable cylinder 10 being extended out of the lower end of the outer cylinder 9, a lower cylinder biasing mechanism 12 for normally biasing the slidable cylinder 10 against a seat 11 securely attached to the bottom of the coaxial hole of the piston 5, a core supporting rod 13 extended through the upper and lower inner cylinders 19 and 10 coaxially thereof with a flange formed adjacent the lower end thereof being abutted against the bottom of a retaining hole 10*a* formed at the lower portion of the lower inner cylinder 10 coaxially thereof, a bias spring 14 disposed in the retaining hole 10*a* between the flange of the rod 13 and a spring retainer fitted over the rod 13, and detecting means 15 for detecting the displacement of the cylinder barrel 4*a* with respect to the cylinder 5 as will be described in more detail hereinafter.

The outer cylinder 9 is made of a steel pipe having high rigidity and a thick wall so that it may be prevented from being deformed by the vibrations of the cylinder barrel 4*a* caused by the rotation of rolls and the reaction to rolling pressure. The outer cylinder 9 extends through the coaxial hole or bore of the cylinder barrel 4*a* and the coaxial hole 16 of the piston 5. The lower end of the lower cylinder 10 which is on the seat 11 as well as the lower end of the rod 13 are machined or otherwise finished to have a partially spherical or cylinderical surface which is convex downward so that they may be permitted to incline on the flat surface of the seat 11.

The lower or slidable cylinder biasing mechanism 12 consists of an annular cylinder chamber 20 defined between the interior surface of the outer cylinder, the stepped portion of the upper or fixed cylinder 19 and the upper end of the lower slidable cylinder 10 and communicated through a radial oil passage 22 with a working chamber defined between the cylinder barrel 4a and the piston 5 so that working oil under high pressure may be admitted into the cylinder chamber 20. As a result, the upper section 21 of the lower slidable cylinder 10 which is liquid-tightly fitted between the outer cylinder 9 and the upper or fixed cylinder 19 serves as a plunger so that the lower slidable cylinder 10 may be forced to keep in contact with the seat 11 under the force of working oil under pressure admitted into the cylinder chamber 20 even when the cylinder barrel 4a is caused to displace itself relative to the piston 5.

The rod 13 is also forced to keep in contact with the seat 11 under the force of the bias spring 14 loaded between the flange and the spring retainer.

The detecting means 15 for detecting the displacement of the cylinder barrel 4a with respect to the piston 5 consists of a differential transformer which in turn consists of a core 23 connected to or integrally extended from the upper end of the rod 13 and a coil 24 into which is fitted the core 23 and which is extended downward from the top of the outer cylinder into the upper section of the coaxial hole of the upper or fixed cylinder 19.

The upper open end of the coaxial bore or hole of the cylinder barrel or body 4a is closed with a cover 29, and the outer cylinder 9 is extended through a sealing ring 30 which is disposed within the coaxial hole of the piston 5 and securely held in position by a seal ring retainer 31.

Next, the mode of operation of the cylinder position detecting device with the above construction will be described. The piston 5 is adjusted in position by the piston position adjusting mechanism 7 shown in FIG. 2. During a rolling operation, a variation in rolling load or pressure causes the variation in position of the bottom backup roll and hence the cylinder barrel 4a. As a result, the coil 24 of the detecting means 15 is caused to move vertically up and down in unison with the cylinder barrel 4a with respect to the core 23 which is held stationary so that the displacement of the cylinder barrel 4a with respect to the piston 5 may be converted into electrical signal in a manner well known in the art.

When the cylinder barrel 4a and hence the outer cylinder 9 are subjected to vibrations due to the rotation of rolls and the reaction to the rolling pressure, each of the lower or slidable cylinder 10 and the rod 13 is caused to incline with a point of contact between the partially spherical lower end face and the flat surface of the seat 11 as a fulcrum point or caused to slide laterally over the seat 11 so that no bending force acts on the rod. As a result the displacement of the core 23 due to the bending of the rod 13 may be positively prevented even when the cylinder barrel 4a is subjected to severe vibrations and consequently the precise detection of the displacement of the cylinder barrel 4a with respect to the piston 5 becomes possible. In addition the lower end portion of the rod 13 is securely retained by the lower slidable cylinder 10 so that even when the cylinder barrel 4a vibrates, no excessive and undesired force acts on the rod.

Even when the vertical position of the piston 5 varies, the working oil under pressure is forced into the cylinder chamber 20 through the radial oil passage 22 so that the lower slidable cylinder 10 is always pressed against the seat 11, and the rod 13 within the lower slidable cylinder 10 is also forced to press against the seat 11 under the force of the bias spring 14. Thus even when the position of the piston 5 varies, the displacement of the cylinder barrel 4a with respect thereto may be detected with a higher degree of accuracy hitherto unattainable by any of the prior art detecting devices.

Figure 6:
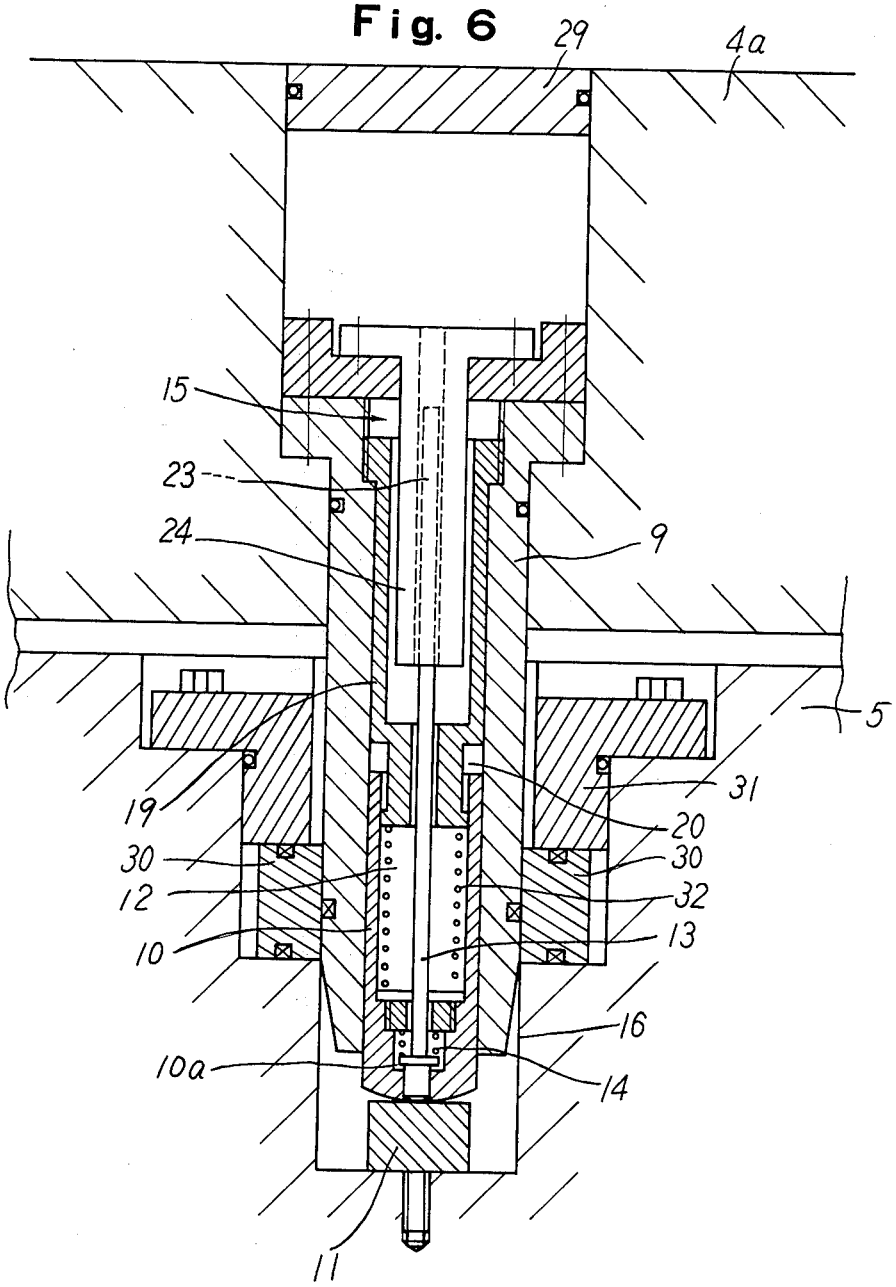
FIG. 6 is a longitudinal sectional view of a second embodiment of the present invention.

In FIG. 6 there is shown the second embodiment of the present invention which is substantially similar in construction to the first embodiment described above in conjunction with FIGS. 4 and 5 except that instead of utilizing hydraulic pressure to force the lower slidable cylinder 10 against the seat 11, a bias spring 32 is used. That is, the bias spring 32 is loaded between the lower end of the upper fixed cylinder 19 and the spring retainer within the lower slidable cylinder 10 so that the latter is normally biased downwardly to be pressed against the seat 11. As with the first embodiment, the second embodiment may detect the displacement of the cylinder barrel 4a with respect to the piston 5 with a higher degree of accuracy.

So far the present invention has been described with reference to the preferred embodiments thereof but it will be understood that the present invention is not limited thereto and that various modifications may be effected without departing from the true spirit of the present invention. For instance, the outer cylinder 9 has been described as being securely attached to the cylinder barrel 4a, but it may be attached to the piston.

In summary, because of the constructions described above even when the cylinder is subjected to severe vibrations during the rolling operation the partially spherical end faces of the lower and slidable inner cylinder and the rod roll or slide over the flat surface of the seat 11 so that the bending of the rod 13 and hence the core 23 may be avoided and consequently the displacement of the cylinder body or barrel 4a with respect to the piston 5 may be detected with a higher degree of accuracy. In addition the inner cylinder biasing mechanism 12 is provided for normally forcing the lower slidable inner clinder against the seat and the bias spring is loaded also for forcing the rod against the seat under a predetermined pressure so that even when the position of the piston 5 is adjusted the displacement of the cylinder barrel 4a with respect to the piston may be detected without any adjustments.

What is claimed is:

1. A hydraulic cylinder position detecting device wherein an outer cylinder is securely fitted into a cylinder body or a piston coaxially thereof and slidably extended into the piston or the cylinder body; an inner cylinder is slidably fitted over one end portion of said outer cylinder; and an inner cylinder biasing mechanism is provided for forcing a lower or upper end of said inner cylinder against a seat attached to the piston or cylinder body respectively.

2. A hydraulic cylinder position detecting device as set forth in claim 1 wherein a lower or upper portion of a rod which is extended through said outer cylinder coaxially thereof is snugly fitted into a rod retaining hole, and a rod biasing spring is loaded for normally pressing the lower or upper end of said rod against said seat.

3. A hydraulic cylinder position detecting device as set forth in claim 1 wherein said inner cylinder biasing mechanism consists of an annular cylinder chamber defined between the interior wall surface of said outer cylinder and the upper or lower end of said inner cylinder and hydraulically communicated through an oil passage with a hydraulic pressure chamber defined between said cylinder body and said piston.

4. A hydraulic cylinder position detecting device as set forth in claim 2 wherein said inner cylinder biasing mechanism consists of an annular cylinder chamber defined between the interior wall surface of said outer cylinder and the upper or lower end of said inner cylinder and hydraulically communicated through an oil passage with a hydraulic pressure chamber defined between said cylinder body and said piston.

5. A hydraulic cylinder position detecting device as set forth in claim 1 wherein said inner cylinder biasing mechaniam consists of a bias spring loaded in said inner cylinder so as to normally bias said inner cylinder downwardly against said seat.

6. A hydraulic cylinder position detecting device as set forth in claim 2 wherein said inner cylinder biasing mecahnism consists of a bias spring loaded in said inner cylinder so as to normally bias said inner cylinder downwardly against said seat.

* * * * *